United States Patent [19]

Suchocki

[11] Patent Number: 4,873,911

[45] Date of Patent: Oct. 17, 1989

[54] DOUBLE LOOP AMMUNITION MAGAZINE OF COMPACT CONSTRUCTION

[75] Inventor: Anthony J. Suchocki, Rochester Hills, Mich.

[73] Assignee: General Dynamics Land Systems, Inc., Warren, Mich.

[21] Appl. No.: 273,940

[22] Filed: Nov. 21, 1988

[51] Int. Cl.[4] ..... F41D 10/22

[52] U.S. Cl. ..... 89/34; 89/45

[58] Field of Search ..... 89/33.02, 33.14, 33.16, 89/33.2, 34, 45, 36.13

[56] References Cited

U.S. PATENT DOCUMENTS

| | | | |
|---|---|---|---|
| 426,890 | 4/1890 | Westphal | 108/22 |
| 1,081,238 | 12/1913 | Kukkuck | 198/570 |
| 1,478,883 | 12/1923 | Barrow | 198/626 |
| 2,437,425 | 3/1948 | Goodhue et al. | 89/34 |
| 2,456,620 | 12/1948 | Chadwick et al. | 89/45 |
| 2,788,713 | 4/1957 | Even | 89/45 |
| 2,800,056 | 7/1957 | Atherton, Jr. | 89/1.803 |
| 2,822,730 | 2/1958 | Brennan et al. | 89/45 |
| 3,496,830 | 2/1970 | Sigrist et al. | 89/1.801 |
| 3,501,996 | 3/1970 | Lipp et al. | 89/34 |
| 4,690,031 | 9/1987 | Metz et al. | 89/36.13 |

FOREIGN PATENT DOCUMENTS

| | | | |
|---|---|---|---|
| 2921893 | 12/1980 | Fed. Rep. of Germany | 89/34 |
| 3238893 | 4/1984 | Fed. Rep. of Germany | 89/34 |

*Primary Examiner*—Deborah L. Kyle
*Assistant Examiner*—Michael J. Carone
*Attorney, Agent, or Firm*—Brooks & Kushman

[57] ABSTRACT

An ammunition magazine (10, 10') for storing rounds of ammunition (14) provides compact storage of endless outer and inner loops (22, 32) for storing first and second sets of the rounds of ammunition. Turns (24, 26) of the outer loop (22) have reaches (28, 30) extending therebetween, and turns (34, 36) of the inner loop (32) have reaches (38, 40) extending therebetween in a nested relationship with the reaches of the outer loop to provide compact storage. A separator plate (42) is located between the reaches (38, 40) of the inner loop (32) to permit movement of the loops with the reaches of the inner loop moving in opposite directions to each other. Storage members (46) of each loop store the rounds of ammunition (14) and are connected by connectors (48) that each include connecting portions (50) receiving adjacent storage members. Each loop (22, 32) preferably has rollers (56) that facilitate movement along the separator plate (42) and along a housing (58) in which the loops are received, and drive members (64) of the loops permit driving of one loop through the other loop by a suitable drive.

20 Claims, 4 Drawing Sheets

DOUBLE LOOP AMMUNITION MAGAZINE OF COMPACT CONSTRUCTION

TECHNICAL FIELD

This invention relates to an ammunition magazine for storing rounds of ammunition.

BACKGROUND ART

Storage of ammunition for guns is most advantageously done compactly so that more rounds can be stored in a given space. This is a particular concern in tanks where the storage space is limited. Likewise, the storage space of ammunition for guns utilized on ships as well as for guns utilized on land facilities is advantageously as compact as possible.

In ammunition storage for current production tanks, the ammunition is located in a compartment behind a ballistic door to protect the crew in case the stored ammunition is impacted by enemy projectiles. Such an arrangement requires the loader to open the door and remove the ammunition round from its particular compartment such that the loader must move between the gun and different locations during loading rather than being able to move in any constant cycle along the same path of motion for each loading and unloading step.

Prior art ammunition magazines noted by an investigation conducted for the present invention are disclosed by U.S. Pat. Nos. 2,800,056 Atherton, Jr. and 3,496,830 Sigrist et al.

Other non-analogous prior art references noted by the investigation mentioned above are disclosed by U.S. Pat. Nos. 426,890 Westphal; 1,081,238 Kukkuck; and 1,478,883 Barrow.

DISCLOSURE OF INVENTION

An object of the present invention is to provide an improved ammunition magazine for storing rounds of ammunition in a compact manner.

In carrying out the above object and other objects of the invention, an ammunition magazine for storing rounds of ammunition is constructed in accordance with the invention with an outer storage loop of an endless construction for storing a first set of rounds of ammunition. This outer loop has a pair of turns and a pair of generally straight reaches extending between its turns. An inner storage loop of the magazine also has an endless constructioon and is located within the outer loop to provide storage of a second set of rounds of ammunition. This inner loop also has a pair of turns and a pair of generally straight reaches that extend between its turns and are respectively nested with the pair of straight reaches of the outer loop in order to provide compact storage. A separator plate of the magazine separates the reaches of the inner loop from each other to permit movement of the loops with the reaches of the inner loop moving in opposite directions with respect to each other.

In the preferred construction of the ammunition magazine, each storage loop includes elongated storage members in which the rounds of ammunition are stored and also includes connectors that connect the storage members while permitting rotational movement therebetween as the loops around their turns. These elongated storage members preferably have round cross sections along their lengths. Each connector in the preferred construction includes a pair of round connecting portions secured to each other and receiving adjacent storage members. One connecting portion of each connector has a fixed connection to the storage member received thereby and the storage member received within the other connecting portion of each connector is rotatable with respect thereto to permit the relative rotation between the adjacent storage members at the turns of the loops.

The preferred construction of the ammunition magazine also has the inner storage loop provided with rollers for rolling along the separator plate to facilitate the movement of the loops. A housing of the magazine receives both the inner and outer storage loops in the preferred construction, and the other storage loop has rollers that roll along the housing to facilitate the movement of the loops in the same manner provided by the rolling of the rollers on the inner loop along the separator plate.

Both the inner and outer storage loops of the preferred construction of the ammunition magazine have drive members for driving one loop by the other loop. The loops each include drive members that cooperate with the drive members of the other loop in pairs, with the drive members of each loop having engagement surfaces that respectively engage the engagement surfaces of the drive members of the other loop to provide the driving relationship between the loops.

The connectors of each storage loop are preferably arranged in a pair or rows with the connectors of each row connecting alternating pairs of storage members in a staggered relationship with the connectors of the other row. Also, the drive members of each storage loop are preferably mounted on the connectors that connect the storage members of the loop.

The objects, features, and advantages of the present invention are readily apparent from the following detailed description of the best modes for carrying out the invention when taken in connection with the accompanying drawings.

BEST MODES FOR CARRYING OUT THE INVENTION

Figure 1:
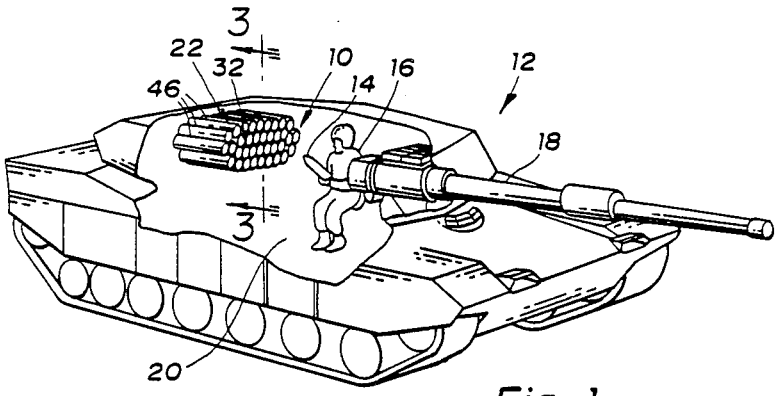
FIG. 1 is a partially broken away perspective view of a tank which includes an ammunition magazine constructed in accordance with the present invention.
Figure 2:
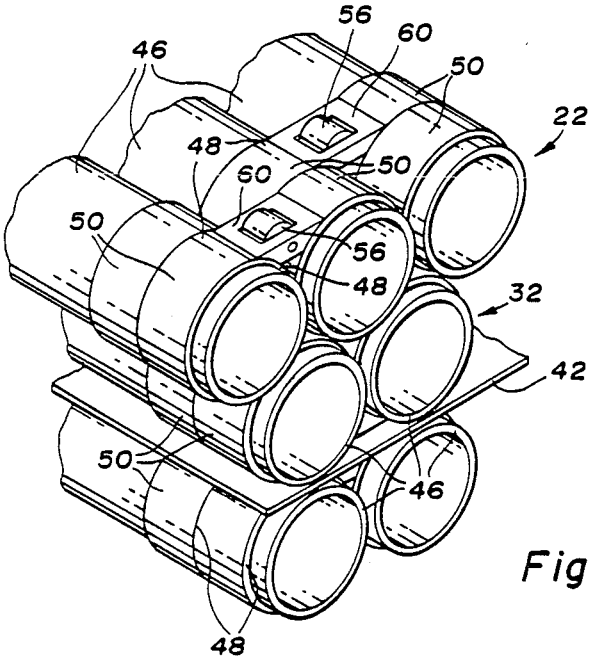
FIG. 2 is a partially broken away perspective view of the ammunition magazine.

With reference to FIG. 1 of the drawings, an ammunition magazine 10 is constructed in accordance with the present invention as is hereinafter more fully described and is shown as being used in a tank 12 which is a use for which the ammunition magazine has particular utility in providing compact storage of rounds of ammunition 14. The tank crew member 16 assigned to loading loads the ammunition rounds 14 within the breech end of the tank gun 18 for firing. The limited space of the tank crew compartment 20 limits the space available for ammunition storage such that the compact storage provided by the magazine 10 allows more rounds to be stored than with conventional ammunition storage within tanks.

Figure 3:
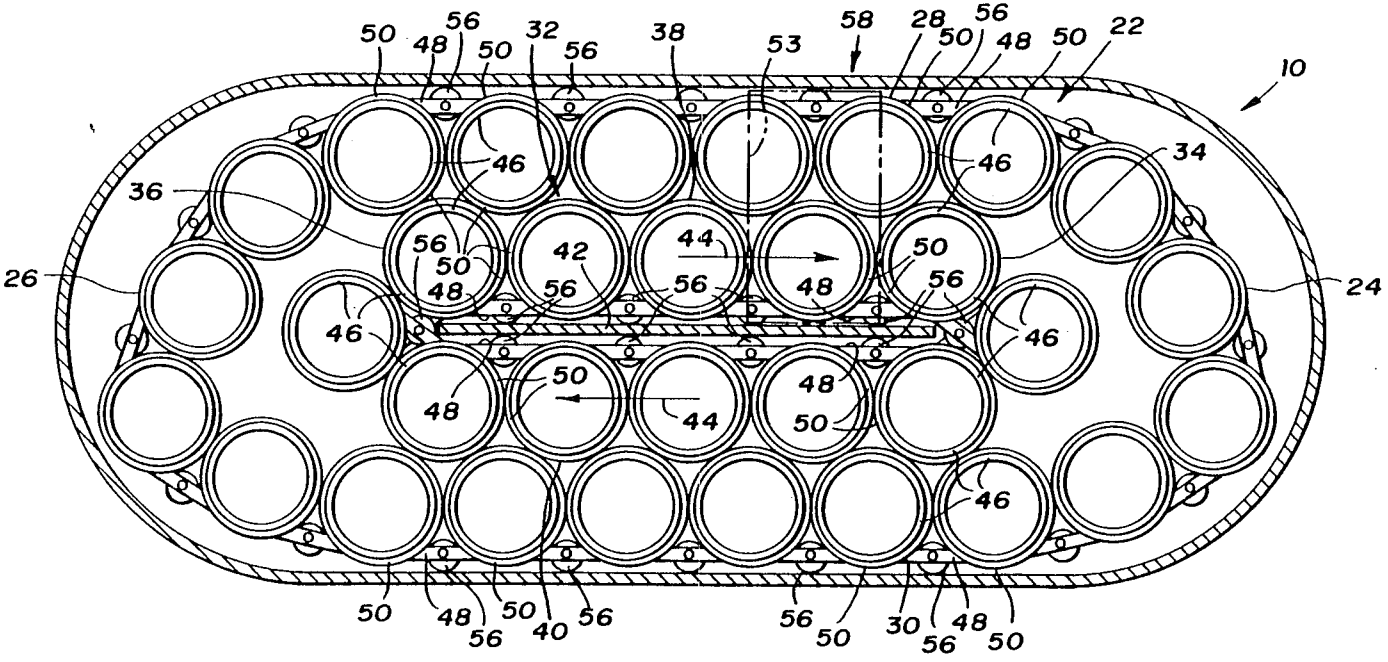
FIG. 3 is a partially sectioned view of one embodiment of the magazine taken along the direction of line 3—3 in FIG. 1.

As illustrated in FIG. 3, the ammunition magazine 10 includes an outer loop 22 of a continuous or endless construction for storing a first set of rounds of ammunition. This outer loop 22 has a pair of turns 24 and 26 and a pair of generally straight reaches 28 and 30 extending between its ends at upper and lower locations as illustrated. An inner storage loop 32 of the ammunition magazine has a continuous or endless construction including a pair of turns 34 and 36 and a pair of generally straight reaches 38 and 40 extending between its turns at upper and lower locations as illustrated. The upper and lower reaches 38 and 40 of the inner loop 32 are respectively nested with the upper and lower reaches 28 and 30 of the outer loop 22 so as to provide compact storge of the rounds of ammunition. A separator plate 42 of the magazine is located between and separates the upper and lower reaches 38 and 40 of the inner loop 32 to permit movement of the loops with the reaches of the inner loop moving in opposite directions to each other as shown by arrows 44 without any interference therebetween as the movement takes place.

In the preferred construction as best illustrated in FIGS. 1, 2, 5 and 6, each continuous loop 22 and 32 includes elongated hollow storage members 46 in which the rounds of ammunition are stored prior to use. Each continuous loop 22 and 32 also includes connectors 48 that connect the storage members while permitting rotational movement therebetween as the loops move around their turns at the opposite ends of the separator plate 42. These elongated storage members 46 preferably have round cross sections along their lengths and each connector 48 includes a pair of round connecting portions 50 secured to each other and receiving the adjacent storage members 46. One connecting portion 50 of each container 48 has a fixed connection 52 such as a weld or another suitable type of securement as shown by schematic representation in FIG. 6. The storage member 46 received by the other connecting portion 50 of each connector 48 is rotatable with respect thereto to permit relative rotation between the adjacent storage members at the turns of the loops 22 and 32. This construction permits the magazine to be accessible through a suitable access door opening 53 (FIG. 3) with the use of a latch mechanism mounted on each storage member 46 to hold the ammunition round within the storage member while being releasable by manual actuation at the same location without any rotation about the central elongated axis of the storage member. Also, the round storage members 46 at the outer reaches 28 and 30 have their centers positioned from the centers of the round storage members 46 of the inner reaches 38 and 40 a distance less than twice the radius of the storage members due to the nested relationship of the outer and inner reaches. This nested relationship with each storage member 46 of each reach engaged at spaced locations with two storage members of the other reach provides the compact storage with a shorter total height of the ammunition magazine than would be the case without such meeting.

Figure 6:
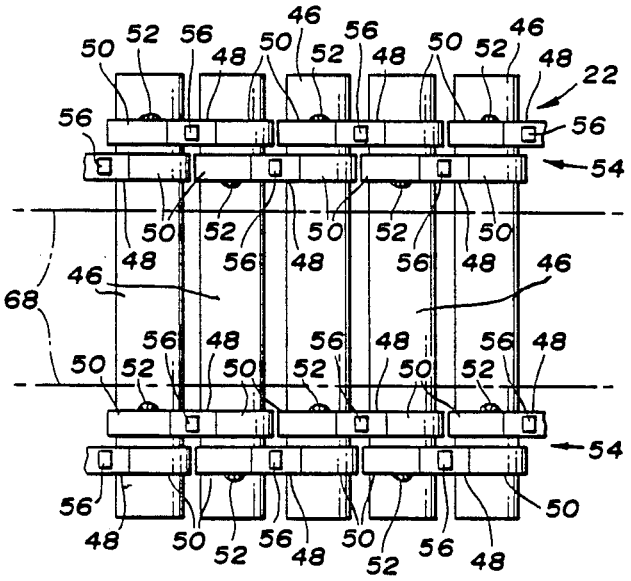
FIG. 6 is a plan view taken along the direction of line 6—6 in FIG. 5 to further illustrate the construction of the storage loops.

As shown in FIG. 6, the connectors 48 are located in sets 54 at the opposite ends of the storage members 46, and each connector set 54 has two rows of the connectors 48 arranged in a staggered relationship such that each row connects alternating pairs of the storage members 46 so as to thereby provide the associated continuous loop.

As best shown in FIG. 3, the inner loop 32 preferably includes rollers 56 for rolling along the separator plate 42 to facilitate the movement of the loops. Ammunition magazine 10 as shown in FIG. 3 also preferably has a housing 58 that receives the outer and inner loops 22 and 32 for storing the rounds of ammunition as previously described. The outer loop 22 also preferably includes rollers 56 like the inner loop for rolling along the interior of the housing 58 at the upper and lower reaches 28 and 30 of the outer loop. This housing 58 also preferably has end walls which are not shown for supporting the separator plate 42. The one unshown end wall closest to the crew compartment defines the access door opening 53 with which each storage member 46 is aligned to permit insertion and removal of an associated round of ammunition. Also, each connector 48 as shown in FIG. 5 has a central connecting portion 60 that extends between the round connecting portions 50 and supports a pin 62 on which its roller 56 is rotatably supported.

Figure 4:
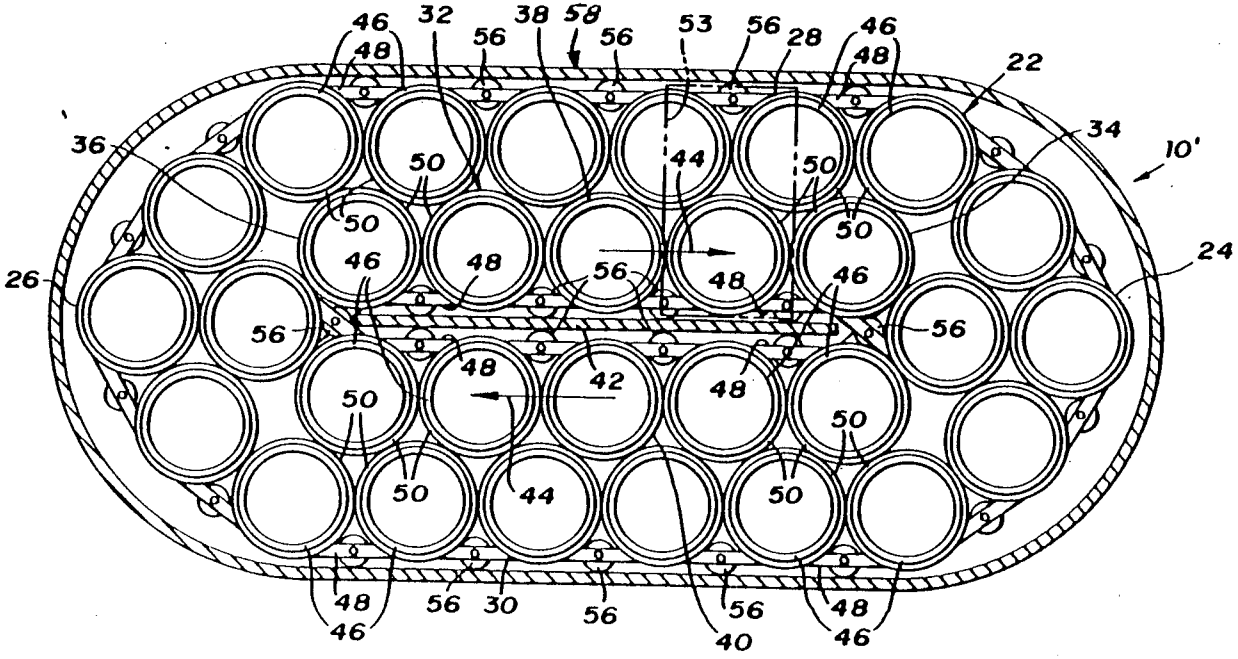
FIG. 4 is a sectional view taken in the same direction as FIG. 3 and illustrating another embodiment of the ammunition magazine with more compact storage.

The embodiment of the ammunition magazine 10 illustrated in FIG. 3 has the outer storage loop 22 constructed with each of its turns 24 and 26 having four more storage members 46 than the adjacent turns 34 and 36 of the inner storge loop 32. In the alternate embodiment shown in FIG. 4, the ammunition magazine 10′ has the same construction as the embodiment of FIG. 3 except for the fact that the outer storage loop 22 has each of its turns 24 and 26 provided with three more storage members 46 than the adjacent turns 34 and 36 of the inner loop 32 so as to thereby have a more compact construction with less wasted space.

Figure 5:
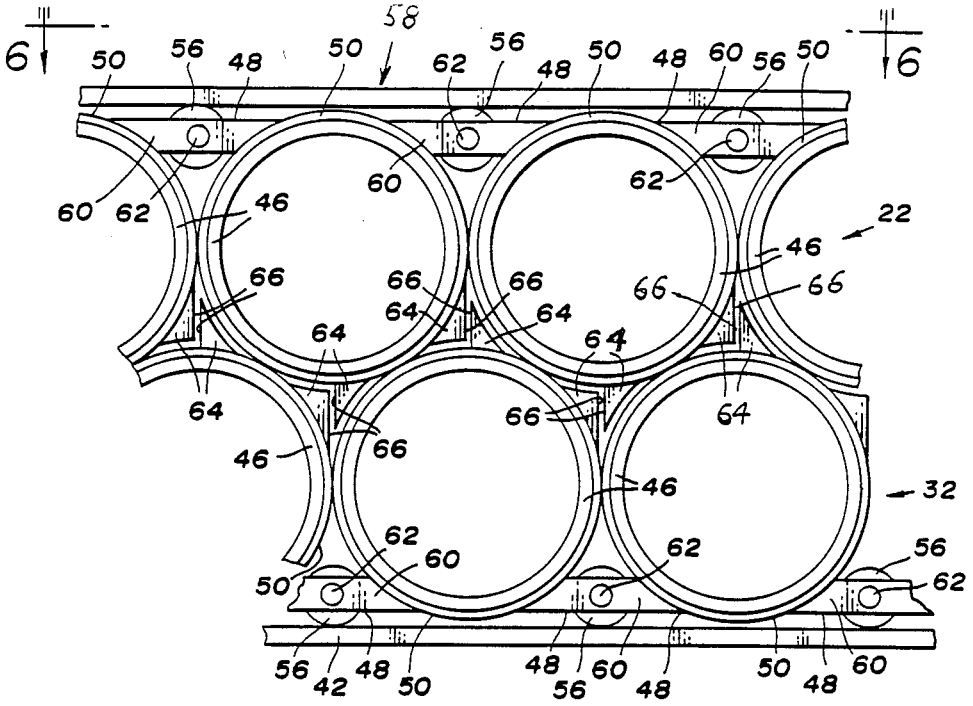
FIG. 5 is a partial view taken in the same direction as FIGS. 3 and 4 and illustrating the manner in which driving takes place between storage loops of the magazine.

As illustrated in FIG. 5, the outer and inner storge loops 22 and 32 preferably each include drive members 64 that cooperate with the drive members of the other loop in pairs. These drive members 64 have engagement surfaces 66 that respectively engage the engagement surfaces of the drive members of the other loop to provide the driving relationship between the loops. Such a construction permits a schematically indicated drive 68 as shown in FIG. 6 to drive one of the loops that provide such driving through the other loop. The drive members 64 are illustrated in FIG. 5 as being supported on the connecting portions 50 of the connectors 48.

While the best modes for carrying out the invention have been described in detail, those familiar with the art to which this invention relates will recognize various alternative designs and embodiments for practicing the invention as defined by the following claims.

What is claimed is:

1. An ammunition magazine for storing rounds of ammunition, comprising: an outer storage loop of an endless construction for storing a first set of rounds of ammunition; the outer loop having a pair of turns and a pair of generally straight reaches extending between its turns; an inner storage loop of an endless construction within the outer loop for storing a second set of rounds of ammunition; the inner loop having a pair of turns and a pair of generally straight reaches extending between its turns and respectively nested with the pair of straight reaches of the outer loop; and a separator plate that separates the reaches of the inner loop from each other to permit movement of the loops with the reaches of the inner loop moving in opposite directions to each other.

2. An ammunition magazine as in claim 1 wherein each storage loop includes elongated storage members in which the rounds of ammunition are stored and also includes connectors that connect the storage members while permitting rotational movement therebetween as the loops move around their turns.

3. An ammunition magazine as in claim 2 wherein the elongated storage members have round cross sections along their lengths.

4. An ammunition magazine as in claim 3 wherein each connector includes a pair of round connecting portions secured to each other and receiving adjacent storage members.

5. An ammunition magazine as in claim 4 wherein one connecting portion of each connector has a fixed connection to the storage member received thereby and wherein the storage member received within the other connecting portion of each connector is rotatable with respect thereto to permit the relative rotation between adjacent storage members at the turns of the loops.

6. An ammunition magazine as in any one of claims 1 through 5 wherein the inner storage loop includes rollers for rolling along the separator plate.

7. An ammunition magazine as in any one of claims 1 through 5 further including a housing that receives the outer and inner storage loops, and the outer loop having rollers that roll along the housing.

8. An ammunition magazine as in any one of claims 1 through 5 further including rollers on the inner storage loop for rolling along the separator plate, rollers on the outer storage loop, and a housing that receives the loops and along which the rollers of the outer loop roll.

9. An ammunition magazine as in any one of claims 1 through 5 wherein the storage loops include drive members for driving one loop by the other loop.

10. An ammunition magazine as in claim 9 wherein the storage loops each include drive members that cooperate with the drive members of the other loop in pairs, and the drive members of each loop having engagement surfaces that respectively engage the engagement surfaces of the drive members of the other loop to provide the driving relationship between the loops.

11. An ammunition magazine for storing rounds of ammunition, comprising: an outer storage loop of an endless construction having elongated storage members for storing a first set of rounds of ammunition; the outer loop having a pair of turns and a pair of generally straight reaches extending between its turns; an inner storage loop of an endless construction located within the outer loop and having elongated storage members for storing a second set of rounds of ammunition; the inner loop having a pair of turns and a pair of generally straight reaches extending between its turns and respectively nested with the pair of straight reaches of the outer loop; each loop having connectors for connecting adjacent storage members; and a separator plate that separates the reaches of the inner loop from each other to permit movement of the loops with the reaches of the inner loop moving in opposite directions to each other.

12. An ammunition magazine for storing rounds of ammunition, comprising: a housing; an outer storage loop of an endless construction received within the housing and having elongated storage members with round cross sections for storing a first set of rounds of ammunition; the outer loop having a pair of turns and a pair of generally straight reaches extending between its turns; the outer loop having rollers that roll along the housing; an inner storage loop of an endless construction located within the outer loop and having elongated storage members with round cross sections for storing a second set of rounds of ammunition; the inner loop having a pair of turns and a pair of generally straight reaches extending between its turns and respectively nested with the pair of straight reaches of the outer loop; the inner loop having rollers; and a separator plate that is located between reaches of the inner loop with the rollers thereof rolling along the separator plate to permit movement of the loops with the reaches of the inner loop moving in opposite directions to each other.

13. An ammunition magazine for storing rounds of ammunition, comprising: a housing; an outer storage loop of an endless construction received within the housing and having elongated storage members with round cross sections for storing a first set of rounds of ammunition; the outer loop having a pair of turns and a pair of generally straight reaches extending between its turns; the outer loop having rollers that roll along the housing; an inner storage loop of an endless construction located within the outer loop and having elongated storage members with round cross sections for storing a second set of rounds of ammunition; the inner loop having a pair of turns and a pair of generally straight reaches extending between its turns and respectively nested with the pair of straight reaches of the outer loop; the inner loop having rollers; a separator plate that is located between reaches of the inner loop with the rollers thereof rolling along the separator plate to permit movement of the loops with the reaches of the inner loop moving in opposite directions to each other; and each loop having connectors that connect adjacent storage members.

14. An ammunition magazine for storing rounds of ammunition, comprising: a housing; an outer storage loop of an endless construction received within the housing and having elongated storage members with round cross sections for storing a first set of rounds of ammunition; the outer loop having a pair of turns and a pair of generally straight reaches extending between its turns; the outer loop having rollers that roll along the housing; an inner storage loop of an endless construction located within the outer loop and having elongated storage members with round cross sections for storing a second set of rounds of ammunition; the inner loop having a pair of turns and a pair of generally straight reaches extending between its turns and respectively nested with the pair of straight reaches of the outer loop; the inner loop having rollers; a separator plate that is located between reaches of the inner loop with the rollers thereof rolling along the separator plate to permit movement of the loops with the reaches of the inner loop moving in opposite directions to each other; each loop having connectors that connect adjacent storage members; each loop also having drive members that cooperate with the drive members of the other loop in pairs; and the drive members of each loop having engagement surfaces that respectively engage the engagement storage of the drive members of the other loop to provide a driving relationship that permits driving of one loop by the other loop.

15. An ammunition magazine as in claim 14 wherein the connectors are arranged in a pair of rows with the connectors of each row connecting alternating pairs of storage members in a staggered relationship with the connectors of the other row.

16. An ammunition magazine as in claim 14 or 15 wherein the drive members are mounted on the connectors.

17. An ammunition magazine for storing rounds of ammunition, comprising: an outer storage loop of an endless construction having elongated storage members for storing a first set of rounds of ammunition; the outer loop having a pair of turns and a pair of generally straight reaches extending between its turns; an inner storage loop of an endless construction located within the outer loop and having elongated storage members for storing a second set of rounds of ammunition; the inner loop having a pair of turns and a pair of generally straight reaches extending between its turns and respectively nested with the pair of straight reaches of the outer loop; a separator plate that separates the reaches of the inner loop from each other to permit movement of the loops with the reaches of the inner loop moving in opposite directions to each other; and each loop including connectors each of which has a pair of connecting portions for receiving adjacent storage members of the loop.

18. An ammunition magazine for storing rounds of ammunition, comprising: an outer storage loop of an endless construction having elongated storage members for storing a first set of rounds of ammunition; the outer loop having a pair of turns and a pair of generally straight reaches extending between its turns; an inner storage loop of an endless construction located within the outer loop and having elongated storage members for storing a second set of rounds of ammunition; the inner loop having a pair of turns and a pair of generally straight reaches extending between its turns and respectively nested with the pair of straight reaches of the outer loop; each loop having connectors for connecting adjacent storage members; a separator plate tht separates the reaches of the inner loop from each other to permit movement of the loops with the reaches of the inner loop moving in opposite directions to each other; each loop including drive members that cooperate with the drive members of the other loop in pairs; and the drive members of each loop having engagement surfaces that respectively engage the engagement surfaces of the drive members of the other loop to provide a driving relationship that permits driving of one loop by the other loop.

19. An ammunition magazine for storing rounds of ammunition, comprising: an outer storage loop of an endless construction having elongated storage members for storing a first set of rounds of ammunition; the outer loop having a pair of turns and a pair of generally straight reaches extending between its turns; an inner storage loop of an endless construction located within the outer loop and having elongated storage members for storing a second set of rounds of ammunition; the inner loop having a pair of turns and a pair of generally straight reaches extending between its turns and respectively nested with the pair of straight reaches of the outer loop; a separator plate that separates the reaches of the inner loop from each other to permit movement of the loops with the reaches of the inner loop moving in opposite directions to each other; each loop including connectors each of which has a pair of connecting portions for receiving adjacent storage members of the loop; the connectors of each loop having drive members that cooperate in pairs with the drive members of the other loop; and the drive members of each loop having engagement surfaces that respectively engage the engagement surfaces of the drive members of the other loop to provide a driving relationship that permits driving of one loop by the other loop.

20. An ammunition magazine as in claim 19 wherein the connectors are arranged in a pair of rows with the connectors of each row connecting alternating pairs of storage members in a staggered relationship with the connectors of the other row.

* * * * *

UNITED STATES PATENT AND TRADEMARK OFFICE

CERTIFICATE OF CORRECTION

PATENT NO. : 4,873,911

DATED : October 17, 1989

INVENTOR(S) : Anthony J. Suchocki

It is certified that error appears in the above-identified patent and that said Letters Patent is hereby corrected as shown below:

Column 1, Line 48
"constructioon" should be --construction--.

Column 3, Line 68
"meeting" should be --nesting--.

Column 6, Line 63, Claim 14
"storage" should be --surfaces--.

Signed and Sealed this

Nineteenth Day of March, 1991

*Attest:*

HARRY F. MANBECK, JR.

*Attesting Officer*

*Commissioner of Patents and Trademarks*